US008262187B2

(12) United States Patent
German et al.

(10) Patent No.: US 8,262,187 B2
(45) Date of Patent: Sep. 11, 2012

(54) OFF-LINE PRINTHEAD INSPECTION AND RECOVERY UNIT FOR PRODUCTION PIEZO INK JET ARCHITECTURES

(75) Inventors: Kristine A. German, Webster, NY (US); Elliott A. Eklund, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 681 days.

(21) Appl. No.: 11/945,556

(22) Filed: Nov. 27, 2007

(65) Prior Publication Data

US 2009/0135220 A1 May 28, 2009

(51) Int. Cl.
*B41J 2/165* (2006.01)

(52) U.S. Cl. ..... 347/19

(58) Field of Classification Search ..... None
See application file for complete search history.

(56) References Cited

U.S. PATENT DOCUMENTS

| | | | | |
|---|---|---|---|---|
| 4,296,418 | A | 10/1981 | Yamazaki et al. | |
| 4,849,769 | A | 7/1989 | Dressler | |
| 4,881,085 | A | 11/1989 | Gibson et al. | |
| 5,257,044 | A | 10/1993 | Carlotta et al. | |
| 5,434,605 | A | 7/1995 | Osborne | |
| 5,786,829 | A | 7/1998 | Pasciak, Jr. et al. | |
| 5,815,175 | A | 9/1998 | Seikel | |
| 5,838,343 | A * | 11/1998 | Chapin et al. | 347/22 |
| 6,254,216 | B1 | 7/2001 | Arway et al. | |
| 6,273,103 | B1 | 8/2001 | Enz et al. | |
| 6,679,577 | B2 | 1/2004 | Du et al. | |
| 6,860,580 | B2 | 3/2005 | Vega et al. | |
| 2005/0156975 | A1 * | 7/2005 | Inoue | 347/13 |
| 2006/0061613 | A1 | 3/2006 | Fienup et al. | |
| 2007/0229567 | A1 * | 10/2007 | Hayashi et al. | 347/17 |

* cited by examiner

*Primary Examiner* — Matthew Luu
*Assistant Examiner* — Alejandro Valencia
(74) *Attorney, Agent, or Firm* — Fay Sharpe LLP

(57) ABSTRACT

A method and apparatus for printhead inspection and recovery in an ink jet printing system includes a modular printhead assembly disposed within the printing system for on-line printing operation. An off-line printhead inspection and recovery unit including a printhead dock for receiving the printhead assembly is locally disposed for ready diagnostic inspection of printhead operation and includes a user interface for reporting diagnostic results. A modular printhead assembly is disposed within the off-line printhead inspection and recovery unit for identifying the head failure to an operator. The inspection and recovery unit may execute a printhead purge and maintenance cycle to repair the failing on-line printing assembly. The inspection and recovery unit maintains a spare head assembly in a heated print-ready state for minimal downtime in production operation upon the replacement of the failing printhead with the spare head from the inspection and recovery unit.

5 Claims, 3 Drawing Sheets

OFF-LINE PRINTHEAD INSPECTION AND RECOVERY UNIT FOR PRODUCTION PIEZO INK JET ARCHITECTURES

BACKGROUND

The presently disclosed embodiments relate to ink jet architectures for high speed production printing, and more particularly, production piezo ink jet (PIJ) architectures employing a large array of printheads in a direct to web architecture; however, the embodiments also apply to other modular jet architectures producing print by employing a large array of printheads.

A piezo ink jet printhead will expel a volume of ink upon an ink chamber contraction resulting from an applied voltage. Normally the ink has to be heated to a comparatively high temperature because the ink will be solid at room temperature. In a production printing embodiment, 20 or more printheads are configured in an array with each printhead having several hundred jets. Because all jets must be working at the same time, reliability requirements for the printheads are compounded. In other words, the need to mitigate disruptions associated with jet failures is critically important in any production printing embodiment that employs large numbers of non-redundant jets.

Printheads experience a jet failure whenever any of their jets are either not jetting enough ink or not jetting any ink at all. Some jet failures are intermittent, which means the corresponding jets either spontaneously recover, or are recovered by a maintenance procedure. Other jet failures are chronic, which means the function of the corresponding jets cannot be recovered. When a jet fails, it is not known if the failure is chronic until several attempts to recover the jet have failed.

The process of attempting to recover failed jets is fairly involved and not always successful. First, a relatively large volume of ink is forced through the head in an effort to purge whatever is blocking the failing jet. The nozzle plate is then wiped and the printhead jetting performance is inspected. The purge, wipe and inspect cycle is repeated until either jet performance is restored or until the service operator considers one or more jet failures to be unrecoverable. With such a large total number of jets, stopping a large production web for every jet shortfall is untenable. Even assuming rates of hard or chronic jet failures are manageable, soft or recoverable printhead failures still have the potential of being very disruptive.

One can imagine that for a large roll of paper comprising a production web, if a purging operation had to occur every time any one of the substantial number of jets failed, then the purge operation would be very disruptive to the extent that no reasonable commercial operation could result. Nevertheless, jet failures have to be dealt with, and in a typical production environment, operators may frequently be faced with an uncomfortable trade-off between printing with less than optimal jet performance versus dealing with the potentially time consuming disruption of performing printhead purge and maintenance cycles, and the additional trouble shooting procedures in the printer to recover one or more printheads. When a failing printhead has to be "swapped" with a replacement head, a "cold swap" is performed so that the system cannot return to a production ready state until the replacement unit and the delivery ink are heated to a print-ready production status and the function of the new head is verified.

The problem sought to be overcome by the subject embodiments is undesirable down time of system functioning due to faulty printheads. A solution would minimize the down time and repair recoverable faulty printheads. More particularly, there is a need for a print system printhead recovery unit to rejuvenate printheads and determine whether or not a head failure is chronic or recoverable so that an operator can assess proper further handling of the faulty printhead while the printing system continues to operate in production mode.

SUMMARY

According to the aspects illustrated herein, there is provided an off-line printhead inspection and recovery unit to rejuvenate printheads and determine whether or not the head failure is chronic or recoverable. The unit comprises component instrumentation to perform printhead maintenance, deliver ink and fire the printhead, as well as sensing to detect failed jets, where the printhead ink delivery subsystem may be comprised in part or in whole of common printing system parts. The availability of such a printhead inspection and recovery unit simultaneously reduces disruption and costs associated with diagnosing and recovering from failed jets.

One disclosed feature of the embodiments comprises a printhead inspection and recovery unit for an ink jet printing system. A modular printhead assembly is disposed within the printing system for on-line printing operation, where the printhead assembly may include a complete ink delivery subsystem or portions thereof. An off-line printhead inspection and recovery unit includes a printhead assembly dock for receiving the printhead assembly wherein the inspection and recovery unit is locally disposed relative to the printing system for ready diagnostic inspection and recovery of printhead operation and includes a user interface for reporting the diagnostic results. The inspection and recovery unit includes a printhead driver/docking module, a head maintenance subsystem, an image receiver, a receiver sensor array, an ink delivery system as necessary and a user interface. A spare modular printhead assembly may be disposed within the off-line printed inspection and maintenance unit and be maintained in the on-line print-ready state.

The head maintenance subsystem includes a head rejuvenator processor for executing printhead maintenance cycles, and also includes a diagnostic processor for selectively identifying nonrecoverable and recoverable printhead failures from data detected by the receiver sensor array.

Another disclosed feature of the embodiments comprises a method for inspecting and maintaining a printhead assembly of an ink jet printing system including an off-line printhead inspection and recovery unit locally associated with the ink jet printing system. A printhead failure in an operating, on-line printhead assembly in the ink jet printing system is identified. The failing on-line printhead assembly is removed and installed in the off-line printhead inspection and recovery unit, wherein the off-line printhead inspection and recovery unit is preconditioned before the installing to an on-line print-ready state. Any jet failures of the off-line printhead assembly are characterized as chronic or recoverable and results are communicated to a system operator through a user interface. The diagnosing comprises one or more off-line maintenance and inspection cycles. Maintenance typically includes purging and wiping the printhead, and inspection is generally achieved by printing on a print receiver and sensing print output by the printing assembly on the print receiver.

DETAILED DESCRIPTION

With reference to the Figures wherein the illustrated embodiments are presented for purposes of illustration and not limitation to the specific embodiments shown therein, a method and apparatus are provided which employs an off-line inspection and recovery unit in an ink jet printing system to rejuvenate failing printheads and determine whether or not a particular head failure is chronic or recoverable, and, if recoverable, restore the printhead to on-line print-ready status.

Figure 1:
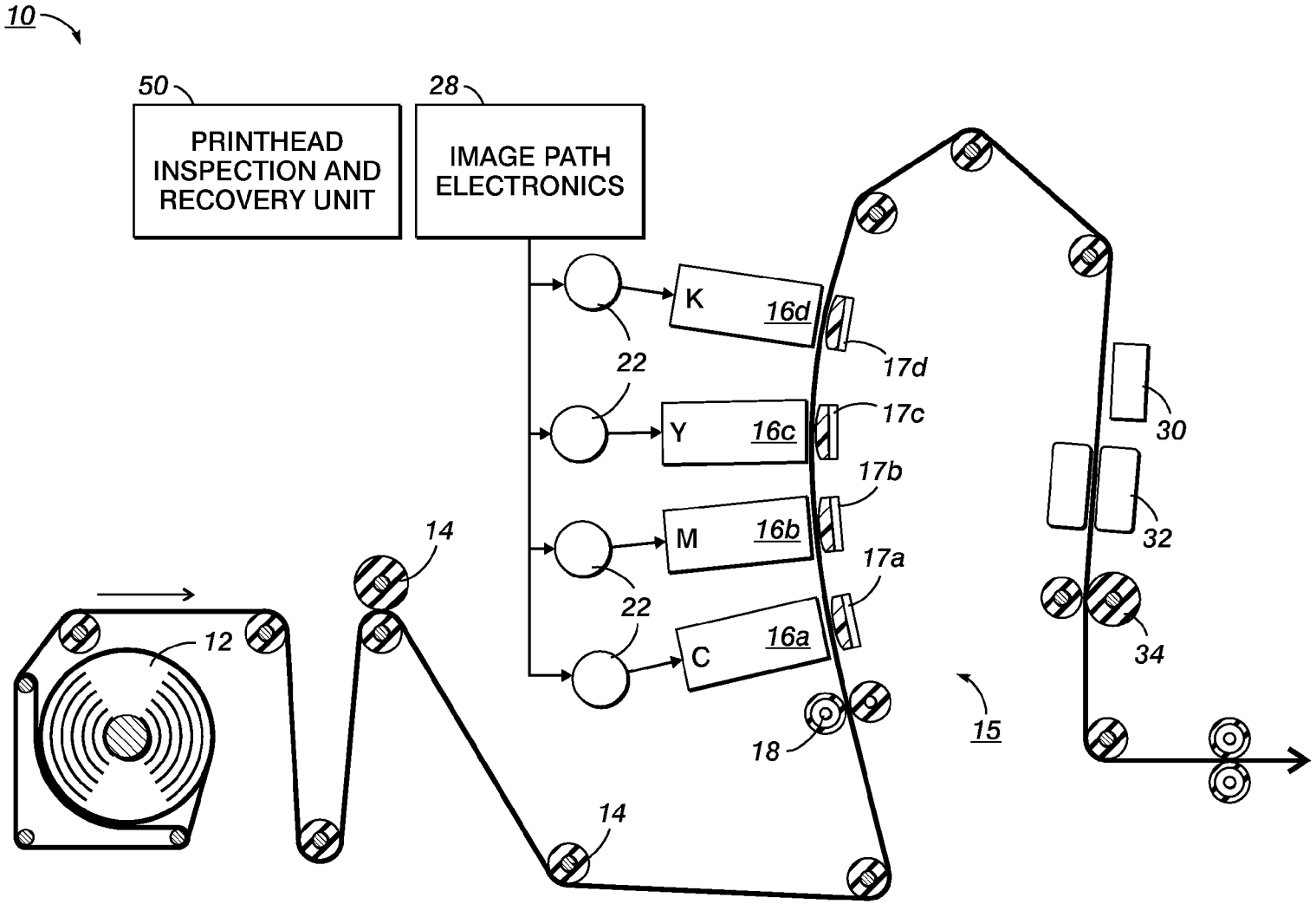
FIG. 1 comprises a schematic assembly drawing of an ink jet printing system; including a plurality of printheads.

With particular reference to FIG. 1, a schematic representation of an ink jet architecture 10 applicable for high speed production printing using piezo ink jet printheads includes a large roll of paper 12, i.e. the web, which is unwound and directed to a plurality of rollers 14 into a print station 15 where the ink is jetted onto the web. The drivable servo-rollers threshold the web 12 into a printing zone comprised of a plurality of printhead assemblies 16*a*, 16*b*, 16*c*, 16*d* which can be a single color or mixed colors in a variety of arrangements supported by web supports 17*a*, 17*b*, 17*c*, 17*d*. The printhead assemblies 16*a*, 16*b*, 16*c*, 16*d* are modular in that they can be selectively removed from an on-line location within the system and replaced or moved to another print station location therein. An ink reservoir and ink delivery subsystem (not explicitly shown) supplies the heated ink in a liquid form to the printheads which similarly must maintain the ink in a liquid state before firing. The printhead assemblies are also disposed in the print station 15 such that the option to perform on-line maintenance exists, albeit with lost productivity. The printhead firing controls 22 are executed by an image path controller 28 and selectively supplies the stimulus to activate the piezos which impart the desired ink onto the web. After ink is jetted onto the web, an image-on-web sensor 30 is disposed to assess which jets are or are not fully functional. Next the ink image is reheated on the web using the midheaters 32 in preparation for a final image gloss and spread unit 34. The printed web is then communicated for further handling in finishing stations (not shown).

An off-line printhead inspection and recovery unit 50 is local to the on-line printing operation being executed by one or more of the printhead assemblies 16 for performing printhead maintenance including ink delivery and firing, as well as sensing failed jets.

Figure 2:
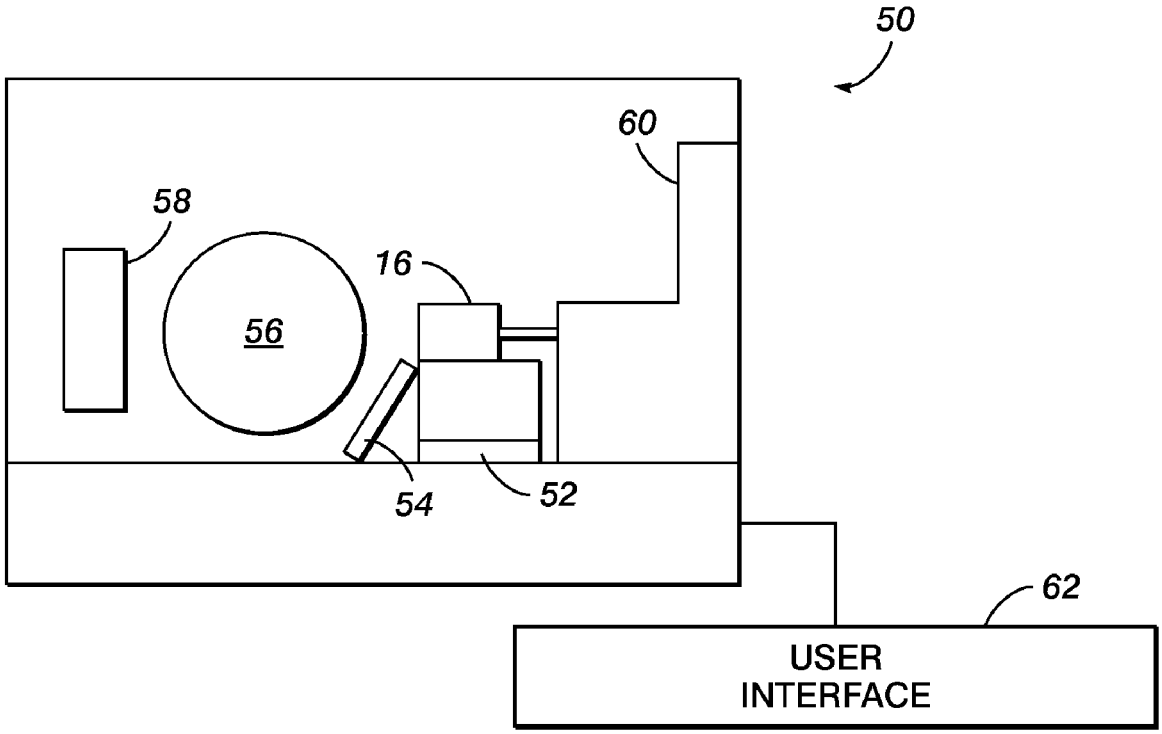
FIG. 2 comprises a schematic of an off-line inspection and recovery unit of the system of FIG. 1.

With particular reference to FIG. 2, elements of the printhead inspection and recovery unit 50 comprise a docking station 52 for receiving the modular printhead assemblies 16 and driving its test operation. A head maintenance subsystem 54, an image receiver drum 56, an ink on a drum (IOD) sensing and control unit 58, and ink delivery subsystem 60 and a user interface 62. Printhead inspection and recovery unit 50 enables operators to carefully diagnose failed printheads, discarding those with confirmed chronic failures and saving rejuvenated printheads for re-installation without affecting the production workflow. In addition, a drum maintenance system (not shown) is associated with the unit 50, such as a cleaning blade with an oil applicator, to maintain the drum for as-needed testing. The inspection and recovery unit 50 is capable of doing all the same maintenance procedures that the system 10 could do, such as the maintenance purge, wipe and inspect cycle described above. The advantageous availability of such an off-line printhead inspection and recovery unit simultaneously reduces disruption and costs associated with both recoverable and non-recoverable printhead failures.

Figure 3:
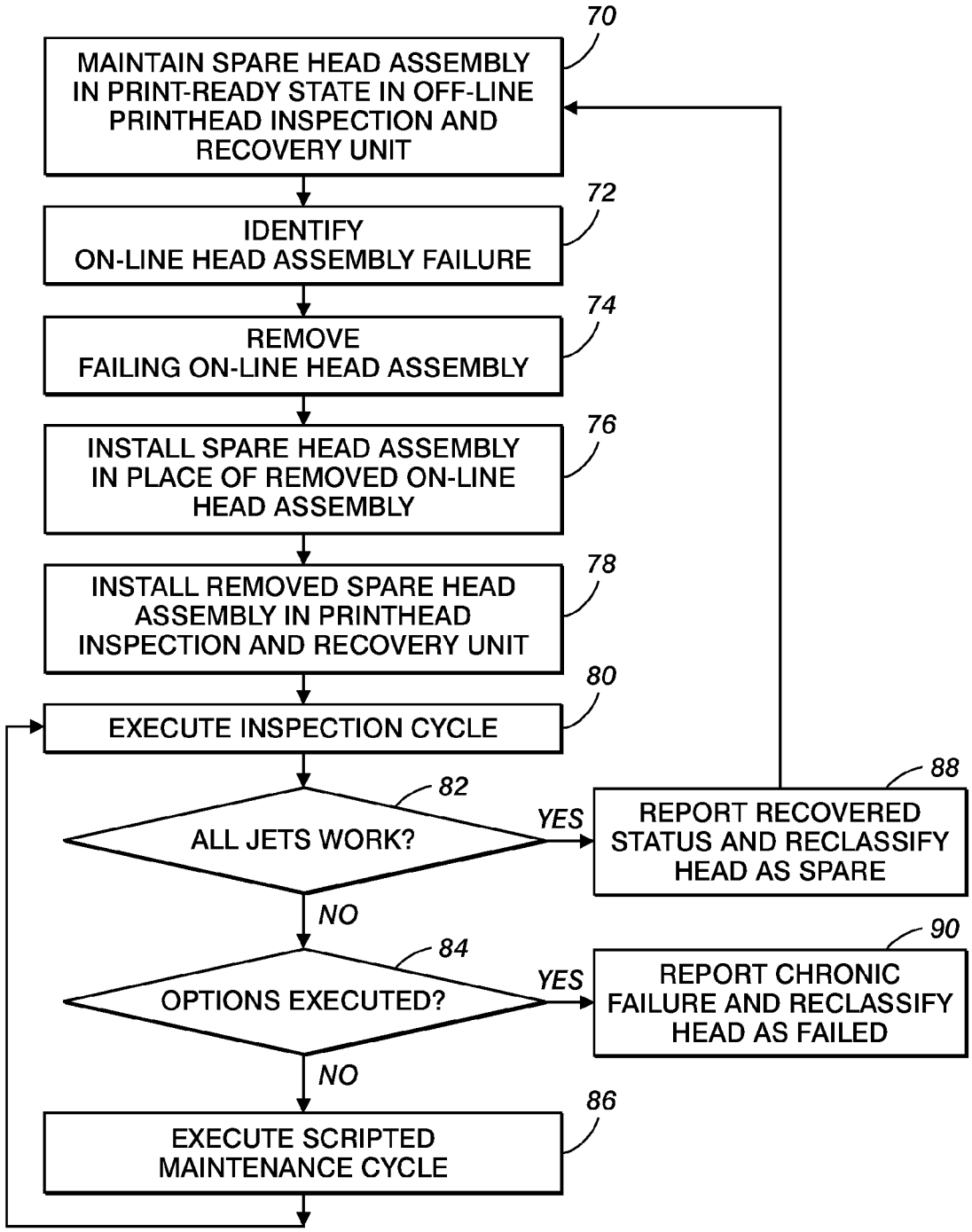
FIG. 3 comprises a flowchart of a method of diagnosing and recovering an identified faulty printhead.

With particular reference to FIGS. 2 and 3, while production system 10 is operating, a spare printhead assembly is maintained 70 in the inspection and recovery unit 50. Such a printhead module may be even a printhead alone or may be a block assembly comprising in whole or in part an ink delivery apparatus associated with the printhead. Furthermore, a printhead module may comprise an assembly of multiple printheads with or without associated ink delivery components. As noted above, for print-ready operation in solid ink embodiments, both the printhead and ink must be in a heated state. A cold printhead is not in a print-ready state and must be heated before the system could use it as an operating printhead. Whatever facilitates the most efficient and beneficial, i.e. minimal interruption, of a system operation should comprise the actual physical assembly of the modular printhead unit 16. Accordingly, by head assembly 16 herein is intended to be a spare assembly at a heated on-line condition for ready replacement of a removed modular printed assembly from the system 10.

While such spare assembly is maintained, an on-line assembly failure may be identified 72. Typically such a failure occurs as a result of a blockage being disposed within the jet. To quickly return the system to a production operation, an operator removes 74 the failing on-line head assembly and installs 76 the fully functional spare head assembly in place of the removed on-line head assembly, and because the spare head assembly is maintained in a print-ready state in the inspection and recovery unit 50, production operation can be quickly returned.

The removed failing on-line head assembly is installed 78 in the printhead inspection and recovery unit 50 where it is supplied ink by the ink delivery system 60 and fired by the docking station 52 to impart ink on the drum 56 which is sensed by the sensor array 58 in a manner to execute an inspection cycle 80. If failed jets are detected, then the first of a set of sequentially scripted maintenance cycles 86 is performed, and the printhead is inspected again 80. A simple example of a set of sequentially scripted maintenance cycles would be a set of five cycles each consisting of a purge and a wipe. Alternative or repetitive actions could be included in any maintenance cycle. The set of sequentially scripted maintenance cycle need not be static. It could be programmed to change in response to whether or not any given jet consistently fails or passes a preset number of maintenance and inspection cycles. The script could also be reprogrammed by an operator. If failed one or more failed jets is still detected after a second inspection 80, the second scripted maintenance option is executed, and the printhead is inspected yet again until either all the jets are working or until the last of the set of sequentially scripted maintenance cycles has been executed 84. If any inspection shows that all jets are working 82 the result is communicated to the operator through the user interface 62 and the head is reclassified as a spare 88. If, on the other hand, failed jets are detected after the set of all sequentially scripted options has been executed 84, then the failure is reported as chronic and the head is reclassified as failed 90. If the printhead is rejuvenated, it can be maintained in the inspection and recovery unit 50 until it is needed as a replacement for another failing printhead within the system 10. The maintenance of the spare head assembly in a print-ready state, locally disposed relative to the system 10, provides advantageous disposition of a replacement spare printhead upon removal of a failing on-line printhead.

Although a drum 56 is shown in the inspection and recovery unit, any type of known image receiver can be employed, such as a belt, that can just as easily facilitate the detection by the sensor array 58 of the imparted ink by the printhead 16.

Structurally, the inspection and recovery unit could be a local stand alone structure, or could be an integral part of the printing system 10. Another alternative is that instead of only swapping printheads between the printer and the unit docking station 52, one could include connectors to the ink delivery subsystem 60, or include the printhead's entire ink delivery subsystem in the swap.

Although the embodiments have been discussed relevant to a particular piezo ink jet architecture, they also are extensible to other ink jet technologies.

For printing technologies, where the ability to "hot swap" printheads exist, these subject embodiments could also be used as a printhead prep and standby station. Specifically, before installing a printhead, an operator could use the inspection and recovery unit 50 to perform all initialization procedures and to also verify that the printhead is working before installation. Such prep and standby steps would further minimize the downtime associated with printhead interventions.

For color printing or as an additional fail safe, the printhead inspection and recovery unit 50 could alternatively have the means to keep multiple printhead assemblies in a standby state. This is especially important for color printing because there is no way to predict which color or head will fail at any given time. Architectural options would include multiple complete units as described for a single printhead assembly;

an integrated unit with multiple stations all having complete inspection and recovery capabilities, but with a common GUI and possibly integrated power, controllers, air handling, etc.; and, an integrated unit with one station for inspection and recovery and multiple stations for holding recovered/spare printhead assemblies in standby.

The inspection and recovery unit 50 may employ alternative jet recovery methods beyond those compatible or desirable in the integrated printing system 10.

It will be appreciated that various aspects of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printhead inspection and recovery unit for an ink jet printing system comprising:

a modular printhead assembly disposed within the printing system for on-line printing operation;

an off-line printhead maintenance unit including a printhead docking module for receiving the printhead assembly wherein the maintenance unit is locally disposed relative to the printing system for ready diagnostic inspection of printhead operation and including a diagnostic processor for determining ink jet failure, a user interface for reporting diagnostic results of the diagnostic processor, wherein the offline printhead maintenance unit further includes a printhead driver module, a head maintenance system, an image receiver, a receiver sensor array, and an ink delivery system, a spare modular printhead assembly is disposed within the off-line printhead maintenance unit wherein the spare modular printhead assembly includes a heater for selectively maintaining the spare assembly at a heated, on-line condition for ready replacement of the modular printhead assembly, and wherein the diagnostic processor further selectively identifies nonrecoverable and recoverable printhead failures from data detected by the receiver sensor array and the diagnostic processor performs the identifying when the printhead assembly is installed in the maintenance unit and the spare modular printhead assembly is installed in the ink jet printing system.

2. The inspection and recovery unit of claim 1 wherein the ink delivery system includes a heater for heating the ink and printhead to an on-line print-ready state.

3. The inspection and recovery unit of claim 1 further including an image receiver maintenance system comprising a cleaning blade.

4. The inspection and recovery unit of claim 1 wherein the head maintenance subsystem includes a head rejuvenator processor for executing printhead purge and maintenance cycles.

5. A method for inspecting and maintaining a printhead assembly of an ink jet printing system including an off-line printhead maintenance unit locally associated with the ink jet printing system, including:

identifying a head failure in an operating, on-line printhead assembly in the ink jet printing systems;

removing the failing on-line printhead assembly from the ink jet printing system;

installing a spare modular printhead assembly kept in a ready-state in the printhead maintenance unit;

installing the failing on-line printhead assembly in the off-line printhead maintenance unit wherein the off-line printhead maintenance unit is preconditioned before the installing to an on-line print-ready state;

diagnosing the failing on-line printhead assembly for a cause of the failing with a diagnostic processor to identify ink jet failure; and, communicating the diagnosed cause to a system operator.

* * * * *